US008479780B2

(12) United States Patent
Fernandez et al.

(10) Patent No.: US 8,479,780 B2
(45) Date of Patent: Jul. 9, 2013

(54) APPARATUS AND METHOD FOR FILLING PAPER LAWN REFUSE BAGS

(76) Inventors: Jesus Daniel Fernandez, Park Ridge, IL (US); David J. Fernandez, Jr., Arlington Heights, IL (US); Nicolas G. Walters, Palatine, IL (US)

( * ) Notice: Subject to any disclaimer, the term of this patent is extended or adjusted under 35 U.S.C. 154(b) by 886 days.

(21) Appl. No.: 12/553,455

(22) Filed: Sep. 3, 2009

(65) Prior Publication Data

US 2010/0108826 A1 May 6, 2010

Related U.S. Application Data

(60) Provisional application No. 61/111,533, filed on Nov. 5, 2008.

(51) Int. Cl.
*B65B 1/04* (2006.01)

(52) U.S. Cl.
USPC ..... 141/10; 141/114; 141/231; 141/316; 141/337; 141/391

(58) Field of Classification Search
USPC ..... 141/10, 114, 231, 313, 314, 316, 141/337, 338, 391
See application file for complete search history.

(56) References Cited

U.S. PATENT DOCUMENTS

| | | | | | |
|---|---|---|---|---|---|
| 4,240,474 | A * | 12/1980 | Perkins | 141/231 |
| 4,442,567 | A * | 4/1984 | Pravettone | 141/108 |
| 5,031,277 | A * | 7/1991 | Coker | 141/313 |
| 5,048,778 | A * | 9/1991 | Wright | 141/391 |
| 5,765,614 | A * | 6/1998 | Kardosh | 141/390 |
| 5,871,037 | A * | 2/1999 | Feldt | 141/391 |
| 5,947,492 | A * | 9/1999 | Hallberg, Jr. | 280/47.24 |
| 5,979,842 | A * | 11/1999 | Fan | 141/391 |
| 6,085,647 | A * | 7/2000 | Burow | 141/391 |
| 6,116,548 | A * | 9/2000 | Oleson | 248/97 |
| 6,994,302 | B1 * | 2/2006 | Simmons | 141/391 |
| 7,032,868 | B2 * | 4/2006 | Mutert | 141/391 |
| 7,686,260 | B1 * | 3/2010 | Tetradis | 248/98 |
| 7,736,057 | B2 * | 6/2010 | VanBost | 141/391 |
| 8,104,778 | B1 * | 1/2012 | Rojas et al. | 280/47.27 |
| 2002/0104932 | A1 * | 8/2002 | Johnston | 248/97 |
| 2007/0289671 | A1 * | 12/2007 | Kolarik | 141/391 |

* cited by examiner

*Primary Examiner* — Gregory Huson
*Assistant Examiner* — Nicolas A Arnett
(74) *Attorney, Agent, or Firm* — Leydig, Voit & Mayer, Ltd.

(57) ABSTRACT

An apparatus for filling top opening refuse bags including an upright bag supporting structure and a separate hopper supportable on the upright structure for directing refuse into a refuse bag. The upright support structure and hopper both have a collapsible design which permits folding from an open operative condition to a substantially flat condition for storage. The hopper is formed by a unique arrangement of trapezoidal panels which permit collapsing of the hopper to the substantially flat condition.

25 Claims, 5 Drawing Sheets

APPARATUS AND METHOD FOR FILLING PAPER LAWN REFUSE BAGS

CROSS-REFERENCE TO RELATED APPLICATIONS

This patent application claims the benefit of U.S. Provisional Patent Application No. 61/111,533, filed Nov. 5, 2008, which is incorporated by reference.

FIELD OF THE INVENTION

The present invention relates generally to lawn and garden devices, and more particularly, to an apparatus and method for filling paper lawn refuse bags.

BACKGROUND OF THE INVENTION

In recent years, many municipalities have adopted a policy of requiring the use of paper lawn refuse bags, which are biodegradable. While paper lawn refuse bags represent a growing trend since they can be composted with the lawn refuse contents, such as leaves or grass clippings, they nonetheless present practical difficulties in their use.

Because of their inherent flexibility, filling of such refuse bags can be tedious and difficult. They are particularly difficult to be filled by an individual. Such refuse bags tend to fold up on themselves causing them to tip from an upward position if a second person is not available to firmly hold and support the bag while another loads the bag with the refuse.

Moreover, because such refuse bags are relatively large, typically being a standardized 30 gallon capacity in size, when fully loaded they can be heavy and difficult to move and transport. Furthermore, because such refuse bags are manufactured of paper, they can become easily torn during loading or handling, particularly if the leaves or lawn clippings introduced into the bag are wet. Rupturing of the bag, of course, necessitates reloading of the contents into yet another refuse bag.

While various devices have been proposed to aid in loading of lawn refuse bags, such devices typically are cumbersome to handle, require tedious securement of the bag to a loading stand, require difficult removal procedures following filling of the bag, and are not susceptible to compact or easy storage. Such devices also do not facilitate handling or transport of the bag when filled, or removal of the filled bag from the device without damage.

OBJECTS AND SUMMARY OF THE INVENTION

It is an object of the present invention to provide an improved apparatus and method for filling paper lawn refuse bags.

Another object is to provide a device for filling lawn refuse bags that is easy to use by a single person.

Another object is to provide a lawn refuse bag filling device as characterized above that is effective for supporting and maintaining the top of the bag open during filling without positive securement of the bag to a loading stand.

A further object is to provide a lawn refuse bag filling device of the foregoing type that effectively supports the bag without rupturing or tearing during filling and subsequent handling and transport of the filled refuse bag.

Yet another object is to provide a lawn refuse bag filling device of the above kind that is simple and economical construction and which lends itself to compact storage.

Other objects and advantages of the invention will become apparent upon reading the following detailed description and upon reference to the drawings, in which:

Figure 1:
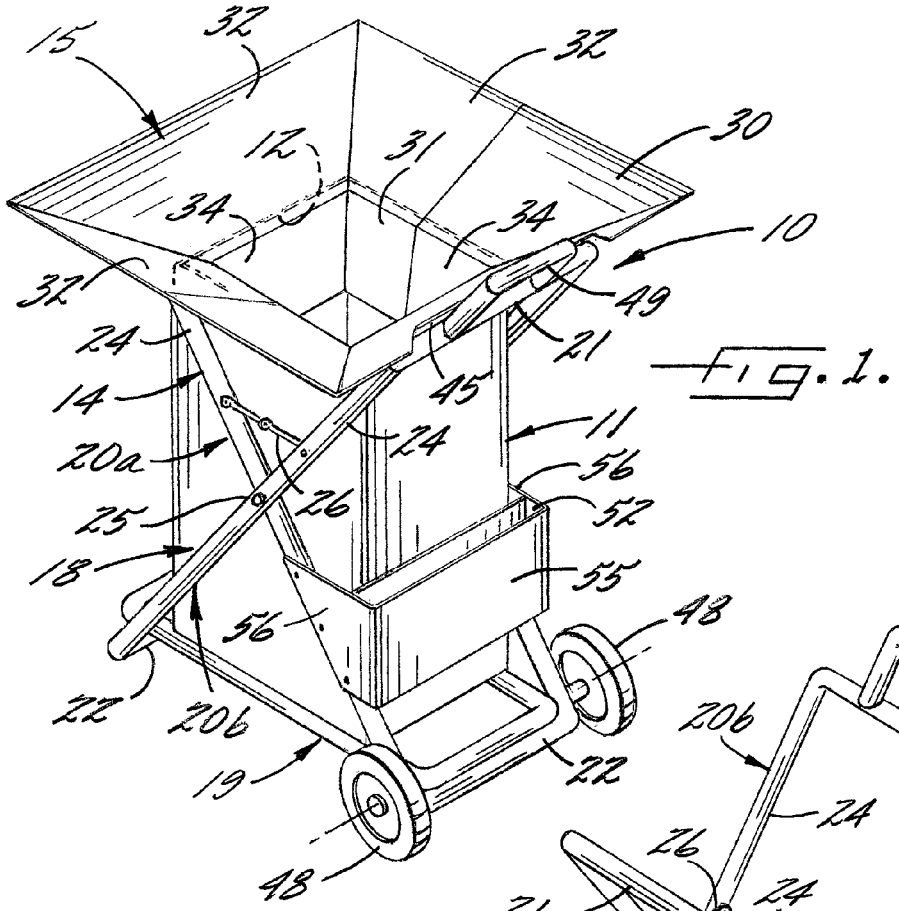
FIG. 1 is a perspective of an illustrative lawn refuse bag filling device in accordance with the invention shown with a bag and hopper in position for filling.
Figure 2:
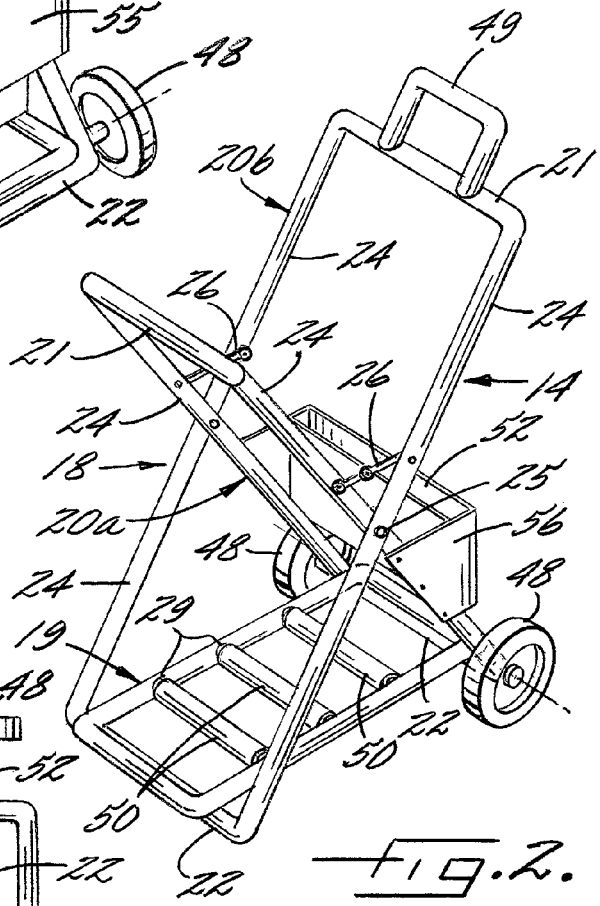
FIG. 2 is a perspective view of the bag support stand of the device shown in FIG. 1.
Figure 3:
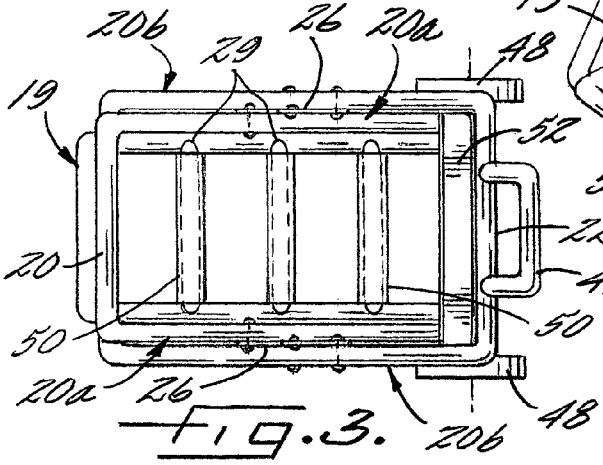
FIG. 3 is a top view of the bag support stand shown in FIG. 2.

While the invention is susceptible of various modifications and alternative constructions, a certain illustrative embodiments thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DESCRIPTION OF THE PREFERRED EMBODIMENTS

Referring now more particularly to the drawings, there is shown an illustrative device 10 for use in filling paper lawn refuse bags, such as the bag 11, which typically is a standardized 30 gallon paper lawn refuse bag having a substantially rectangular upper open end 12. It will be appreciated that FIGS. 1-11 depict the illustrative device, while FIGS. 12-16 shows an embodiment with some limited differences which will become apparent. For purposes herein, similar items in the illustrative embodiments have been give similar reference numerals.

The device 10 in this instance includes an easily moveable cart-like support frame 14 and a hopper 15 removably positionable into and supported by a top of the support frame 14. The illustrated support frame 14 has a tubular construction comprising an X-frame upright support structure 18 and a bottom bag supporting frame 19, which both may be made of metal or plastic tubular frame elements. The X-frame upright structure 18, in this case, comprises a pair of rectangular frame members units 20*a*, 20*b* each having upper and lower horizontal legs 21, 22, respectfully, interconnected by upwardly extending parallel longer legs 24. Adjacent crossing upwardly extending legs 24 of the rectangular frame units 20*a*, 20*b*, are pivotably connected by a hinge pin 25 at a mid point. A collapsible locking cross link 26 interconnects adjacent upwardly extending legs 24 of the X-frame units 20*a*, 20*b* at a location intermediate the respective hinge pins 25 and their upper ends for maintaining the rectangular frame units 20*a*, 20*b* in predetermined angular upright supporting relation to each other. Alternatively, in lieu of cross links 26, the pivots of upwardly extending legs 24 of the frame units may be formed with outwardly projecting curve brackets 27, shaped complementary to the curvature of the legs 24, for limiting outward movement of the frame units 20*a*, 20*b* to a predetermined opened or operative condition, without the use of cross links. (See FIGS. 12-14)

For supporting the refuse bag 14, the bottom frame 19 comprises an outer rectangular frame and a plurality of bag supporting cross bars 29 extending transversely between elongated sides of the rectangular frame in parallel relation to the upper and lower horizontal legs 21, 22 of the X-frame. The bottom frame 19 in this case is pivotably supported at one end to the upwardly extending legs 24 of the rectangular frame unit 20*a* immediately above the horizontal frame member 22 with the other end resting upon and being supported by the horizontal frame member 22 of the other rectangular frame unit 20*b*. The refuse leaf bag 11 is positionable onto the bottom frame 19 from the left side of the support frame as viewed in FIGS. 1-6.

The hopper 15 in this case includes an upper funnel portion 30 and lower chute portion 31, preferably made of suitable lightweight plastic panels. The upper funnel portion 30 has a rectangular shape comprising four generally trapezoidal panels 32. The lower chute portion 31 in this instance also comprises four interconnected trapezoidal panels 34, with sides of the trapezoidal panels 34 angled relative to the sides of the upper funnel portion 30. The lower chute portion 31 is size complementary to the opening between the upper horizontal members 21 of the rectangular frame units 20*a*, 20*b* with the sides of the trapezoidal panel extending in generally parallel relation to the upright members 24 of the support frame, as viewed in FIG. 1.

Figure 4:
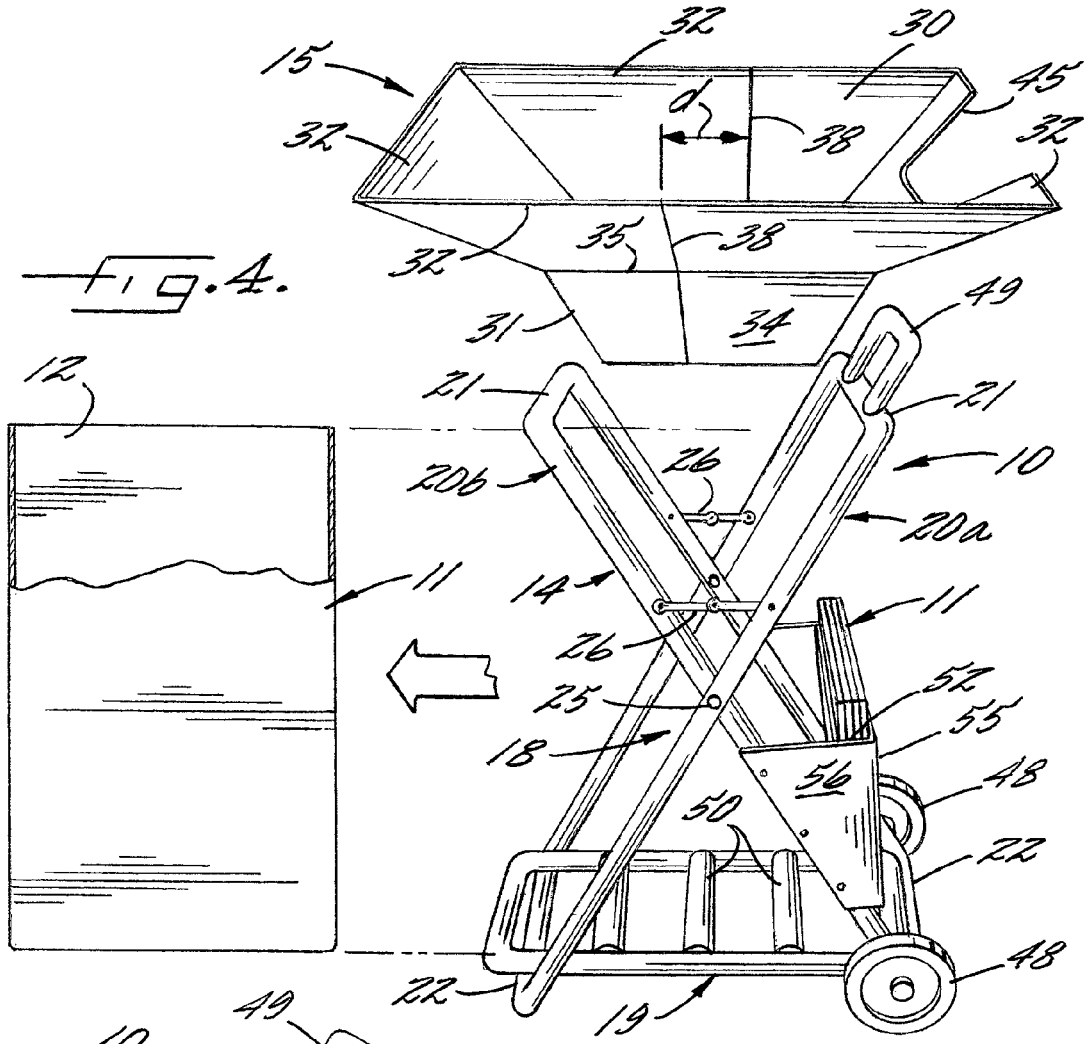
FIG. 4 is an exploded perspective of the refuse bag filling device shown in FIG. 1.

In accordance with one aspect of the invention, the trapezoidal panels 32,34 are unfoldable from a substantially flat planar condition (FIG. 11) into an open operative condition as depicted in FIGS. 1, 4 and 7-9, respectively. To this end, in this case, the trapezoidal panels 32 of the upper funnel portion 30 are connected to the trapezoidal panels 34 of the lower chute portion 31 by horizontal hinged joints 35, and trapezoidal panels 32, 34 comprising the upper funnel portion 30 and the lower chute portion 31 each are also interconnected by a respective flexible side hinged joint 36, 37. To facilitate collapsing of the differently-configured trapezoidal panels 32, 34 of the upper funnel portion 30 and lower chute portion 31, opposing trapezoidal panels of the upper funnel portion and lower chute portion are formed with a respective vertical intermediate hinged joint 38, 39 between their opposed sides. For smaller sized hoppers, the intermediate hinge joints 38, 39 of opposed trapezoidal panels may be in aligned relation to each other, depicted in FIGS. 10-11, permitting folding of the hopper to a substantially flat condition for storage. For larger sized hoppers, the intermediate hinged joints 38, 39 of the trapezoidal panels 32, 34 on one side of the hopper are in aligned relation to each other and laterally offset a distance "d" from the aligned intermediate hinged joints 38, 39 of the trapezoidal panels 32, 34 on the opposing side of the chute (FIG. 4). Such unique arrangement of hinged joints 36, 37, 38, 39 particularly enable relatively large sized hopper 15 to be folded into a substantially flat condition.

In keeping with the invention, the hopper 15 while in its substantially flat collapsed condition, is effective for facilitating full opening of a paper refuse bag 11 prior to filling. For this purpose, the chute portion 31 of the hopper 15, while in its collapsed condition, may be inserted diagonally into the top of the bag 11, even when the bag is not in a fully open condition. Expanding the trapezoidal panels 32, 34 of the hopper 15 into its open, operative position, while at the same time orienting the hopper 15 in proper aligned supported position on the support frame 14, expands the chute portion 31 into its open rectangular configuration, causing the bag 11 to fully open and be supported in closely surrounding outer relation to the chute portion 31. It will be appreciated that with the hopper 15 supported on the frame 14 by its outwardly flared upper funnel portion 30, chute portion 31 will retain the closely surrounding upper end of the bag 11 in proper position during the filling, without the requirement for fasteners for positively securing each individual bag on the support frame as is customary in the prior art. Moreover, since the chute portion 31 has a relatively short depth, upon complete filling of the refuse bag 11, the chute portion 31 is easily removable from the bag 11 by simple lifting of the hopper from the support frame 14. Upon removal of the hopper 15, the filled bag 11 supported in upright position on the bottom frame 19 for closure of the top of the bag by an appropriate tie or the like.

With the bag 11 supported on the frame 14 with the chute portion 31 of the hopper 15 properly positioned and retaining the upper end of the bag 11, it can be seen that the bag can be readily filled by dumping leaves or unloading a lawn mover grass hopper into the relatively wide mouth upper funnel portion 30 of the hopper 15, which directs the refuse through the chute portion directly into the refuse bag 11. It will be appreciated that the configuration of the hopper 15 and its positioning on the upper end of support structure 18 enables it to be maintained in place during usage without the necessity for auxiliary fasteners. Alternatively, the hopper may be provided with Velcro strips 44 that that can be secured around the upper horizontal legs 21 of the support structure upon setup prior to usage. (See FIG. 15)

To facilitate easier access of the user to the funnel portion 31 and positioning of a grass hopper or the like directly over the chute portion 31, in the illustrative embodiment, one trapezoidal side 32 of the funnel portion 30 is formed with a cutout 45 which enables the user to stand more closely to the hopper 15 and more easily direct refuse into the hopper 15 and refuse bag 11. As the bag 11 is filled with refuse, it is supported on the bottom frame 19 in elevated position to the ground, free of obstructions which can damage or tear the bag.

Since such 30 gallon refuse bags 11 can be quite heavy when filled to capacity, particularly when filled with grass clippings or wet leaves, in further keeping with the invention, the support frame 14 is adapted for easy transport of the filled leaf bag 11 to an appropriate storage or pickup location. In the illustrative embodiment, the bottom frame 19 is provided with wheels 48 adjacent one end and the rectangular frame unit 20*b* has a U-shaped handle 49, which in this instance, extends forwardly thereof, on a common side of the support frame 14 as the wheels. Hence, the support frame 14 is easily movable, either by pushing or pulling, for transporting a relatively heavy filled bag to a drop off location.

Figure 5:
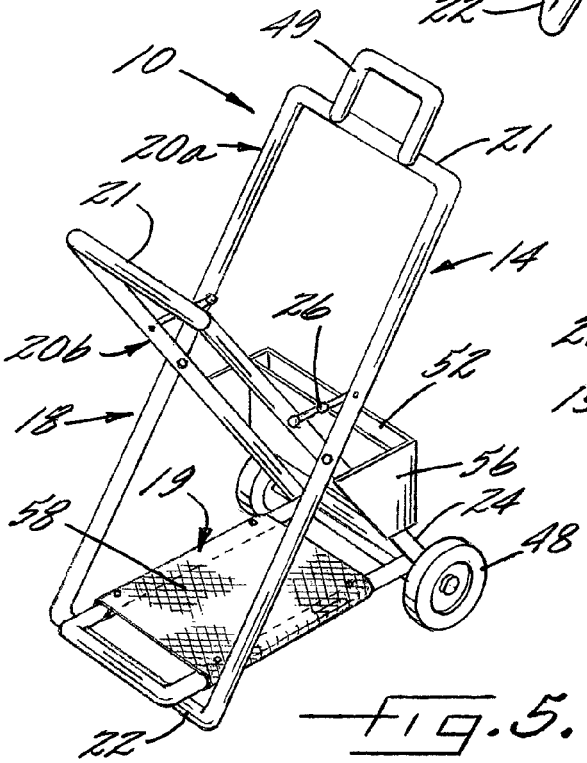
FIGS. 5-6 are respectively perspective and top views, similar to FIGS. 2-3, of a bag support stand with an alternative form of a bottom bag supporting frame.
Figure 6:
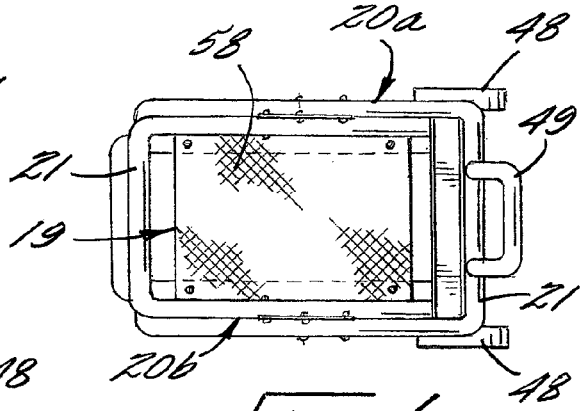
Figure 7:
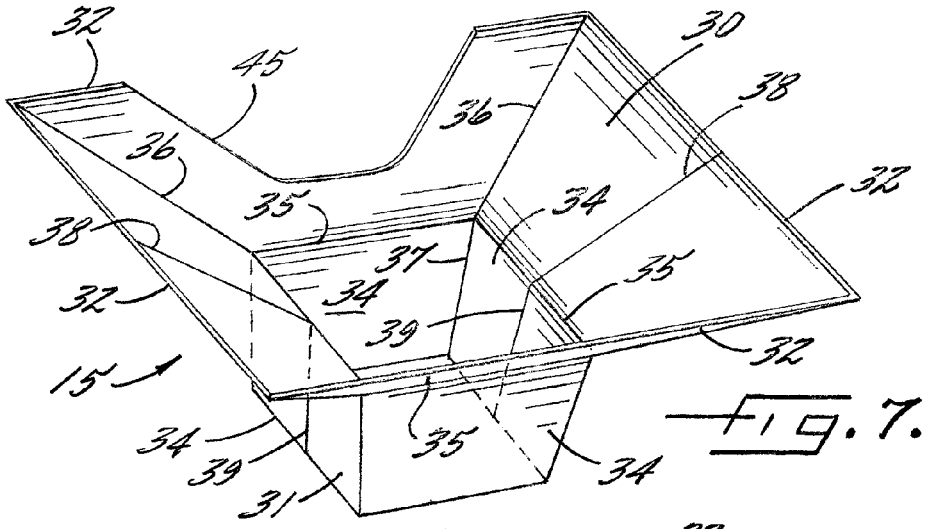
FIG. 7 is a perspective of the collapsible hopper of the lawn refuse bag filling device shown in FIG. 1.
Figure 8:
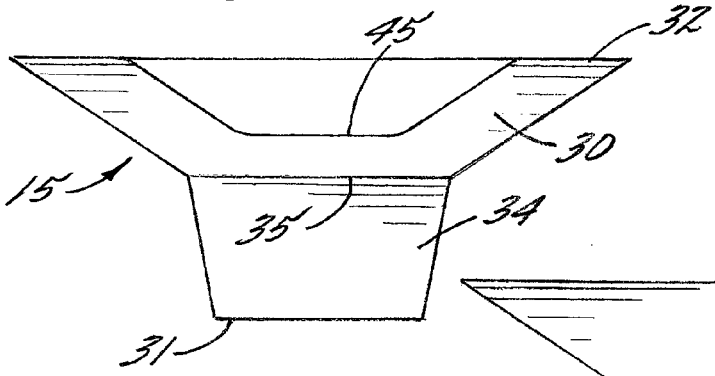
FIG. 8 is a rear elevational view of the hopper shown in FIG. 7.
Figure 9:
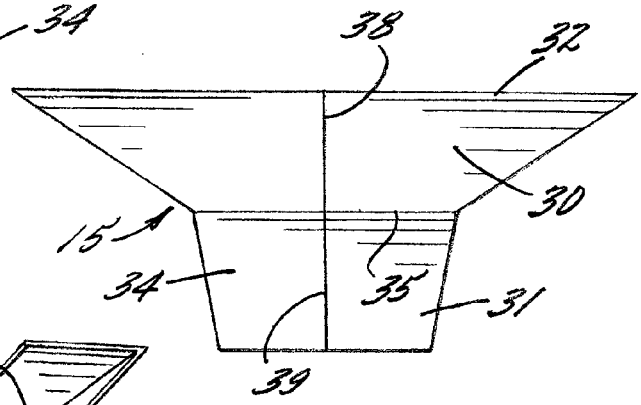
FIG. 9 is a side elevational view of the hopper shown in FIG. 7.
Figure 10:
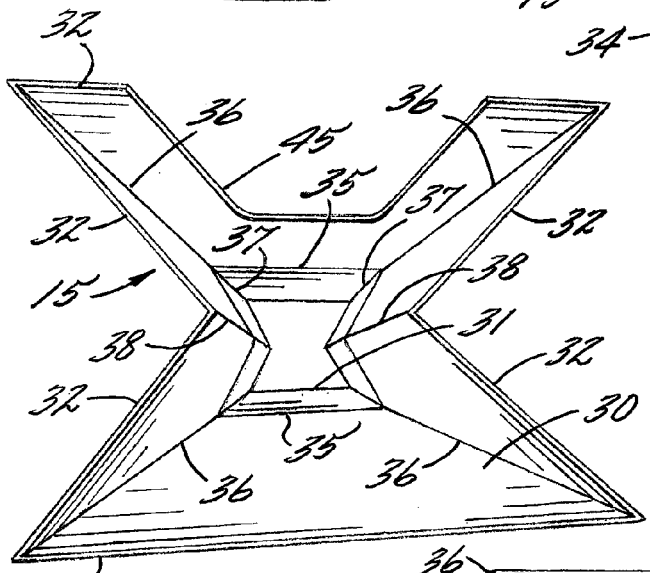
FIG. 10 is an end view of the hopper shown in FIG. 7 being folded into a collapsed condition.
Figure 11:
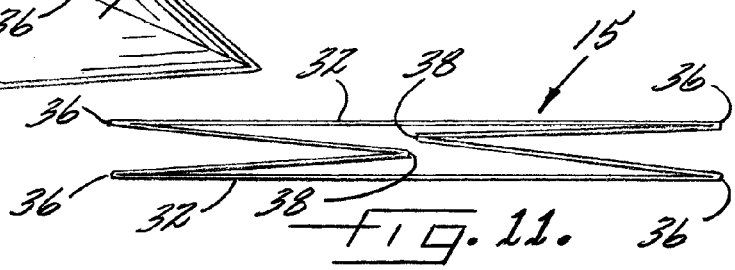
FIG. 11 is a diagrammatic cross-section of the collapsed flat hopper shown in FIG. 10.

To facilitate removal of heavy filled bags 11 from the support structure 14 at the unloading location, the cross members 29 of the bottom frame 19 each carry a respective roller 50, which permits removal of the heavy filled bag from the support frame with relative rolling movement of the rollers 50, without tearing or other damage to the bottom of the bag 11. It can be seen that the filled bag 11 is easily removable from a left side thereof, as viewed in FIG. 4, from between the upright members 24 of the support frame 14. Alternatively, the bottom frame 19 may be provided with a stretched canvas bottom 58, as shown in FIGS. 5-6, for facilitating removal of the bag with relative sliding movement.

Figure 12:
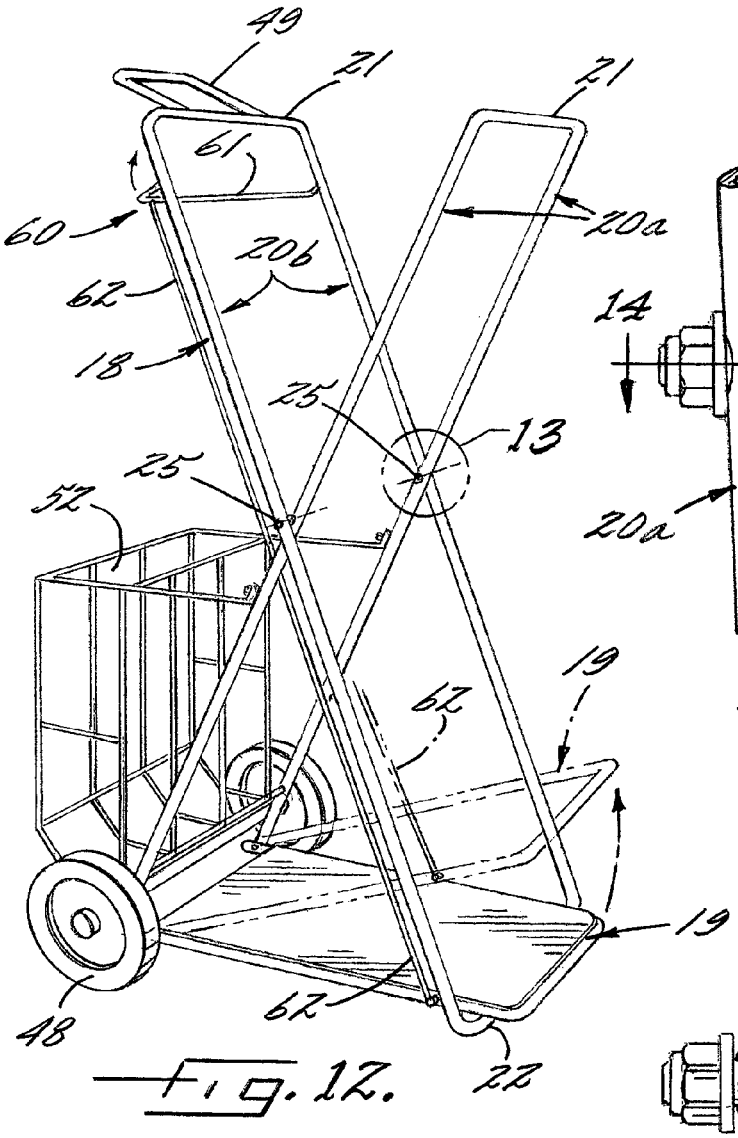
FIG. 12 is a perspective of a prototype of the illustrative lawn refuse filling device, wherein items similar to those identified in the embodiment shown in FIGS. 1-10 have been given similar reference numerals.
Figure 13:
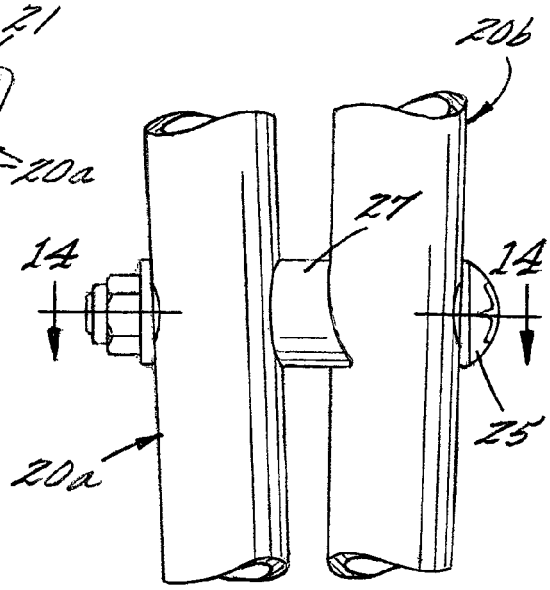
FIG. 13 is an alternative pivot for the bag support frame units.
Figure 14:
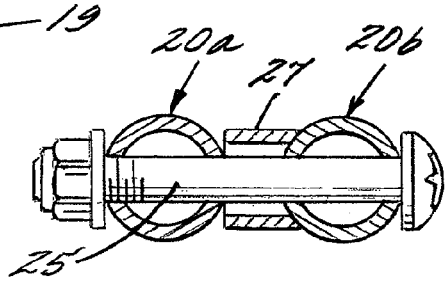
FIG. 14 is an enlarged cross-section taken along the line 14-14 in FIG. 13.
Figure 15:
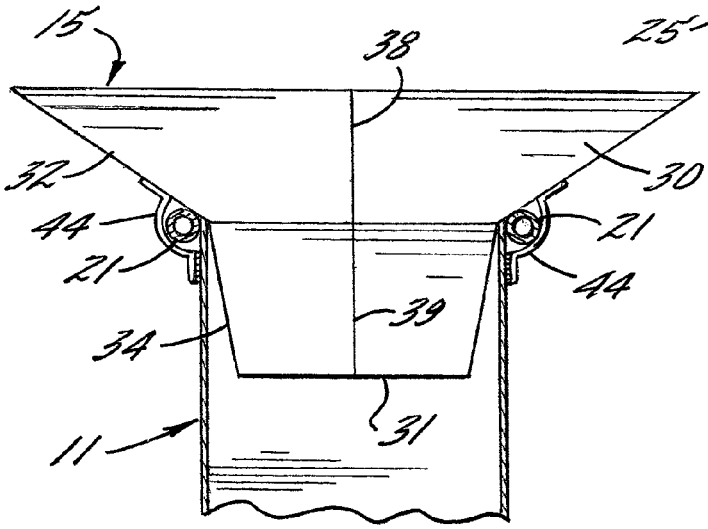
FIG. 15 is a partial side elevational view of alternative fasteners for the hopper.
Figure 16:
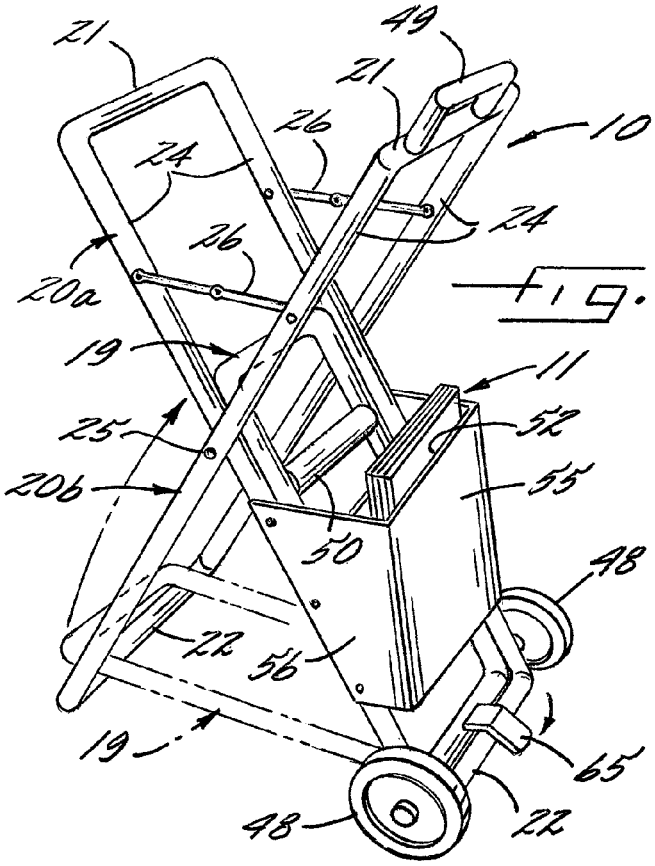
FIG. 16 is a perspective view of the bag support stand with an alternative form of actuating device for moving the bottom frame.

A new bag 11 can then be placed upon the bottom frame 19 in upright position and, the hopper 15, which is easily collapsible, is positionable into the new bag and onto the support frame 14, in the manner described above. For providing easy handling and supply of additional refuse bags 11, the support frame 14 in this case has a refuse bag storage pocket 52 supported thereon. The illustrated pocket 52 is mounted on the rectangular frame unit and comprises a vertical panel 55 and generally triangular side panels 56 for defining an upwardly opening compartment for supporting a supply of refuse bags 11 while in their folded stored condition. Alternatively, the refuse bag storage pocket 52 may have a light weight wire construction as depicted in FIG. 12.

Figure 17:
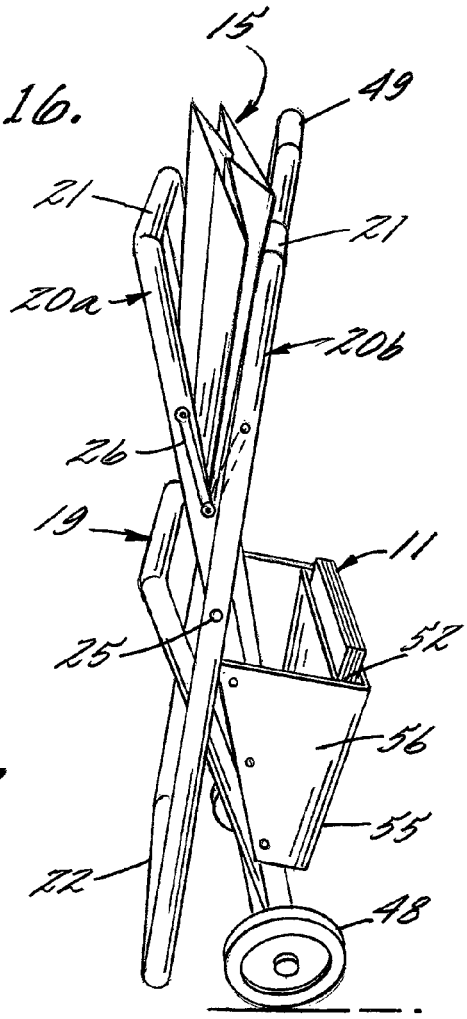
FIGS. 17 and 18 are end and side elevational views of the lawn refuse filling device shown in FIG. 4, with the bag support stand and hopper in a collapsed stored condition.

To facilitate easy and compact storage of the device 10, it can be seen that the bottom frame 19 can be pivoted upwardly about its pivot axis on the rectangular frame unit 20*a* into coplanar relation to the frame unit. Upon release of the bracket 26 in the embodiment of FIGS. 1-4, such as by downward pushing movement, the rectangular frame units 20*a*, 20*b* are pivoted into close relation to each other, as shown in FIG. 17.

To facilitate upward pivotal movement of the bottom frame 19, a mechanical actuator 60 in this case is provided which includes an actuating handle 61 adjacent the handle 49 of the upright support structure 20*b*, which is connected to the bottom frame 19 by a cable 62 such that upward pivotal movement of the bracket will pivot the bottom frame 19 upwardly sufficient that pivotal movement of the frame units 20*a*, 20*b* of the upright structure will cause the bottom frame member to be raised to its upright stored condition as an incident to closure of the X-frame upright structure 18. (See FIG. 12) Alternatively, a foot actuated bracket 65 may be provided on the X-frame structure 18 that can be pivoted for raising the bottom frame upwardly to a position sufficient that it will be urged to a fully raised position as an incident to folding of the X-frame 18. (See FIG. 16)

Figure 18:
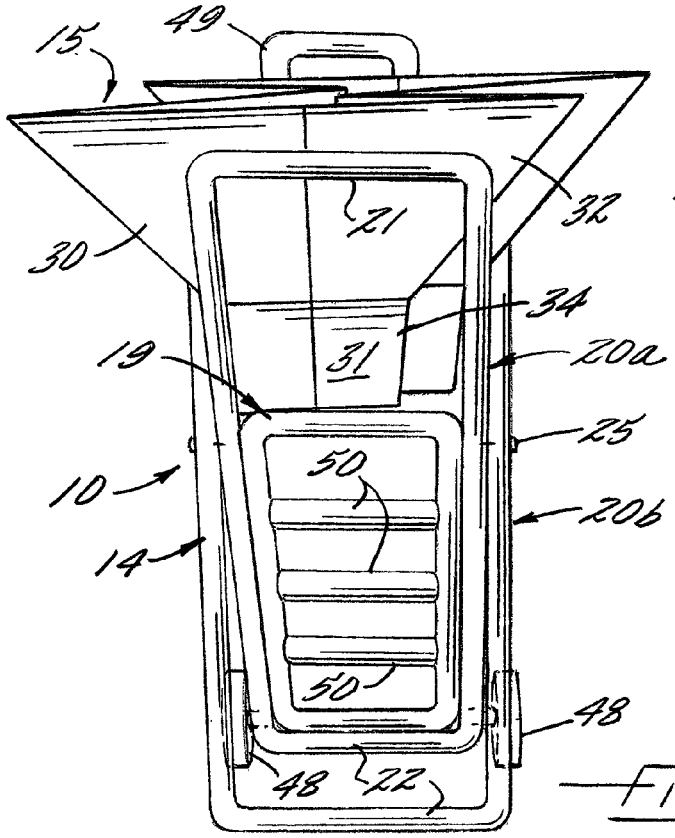

Upon folding of the hopper 15 to its collapsed condition following usage, the hopper can be supported in a small angled cradle defined by the support units 20*a*, 20*b* above the central pivot pin 25. The device 10, even when in its collapsed and stored position as viewed in FIGS. 17-18, can easily be wheeled to and from the storage location by means of the handle 49 while in a slightly tilted condition to the right.

From the foregoing, it can be seen that an improved lawn refuse filling bag device is provided that is easily useable by a single person. The refuse bag filling device is adapted effectively supporting and maintaining the top of the refuse bag in an open condition during filling without positive securement of the bag to a loading stand. The bag further reliably supports the bag without rupturing or tearing during filling and subsequent handling and transport of the filled bag to an unloading area. Yet, the device is relatively simple in construction and lends itself to compact storage.

The invention claimed is:

1. An apparatus for facilitating filling of top opening refuse bags comprising:

a frame having a collapsible upright support structure and a bottom bag supporting platform, said upright support structure defining a downwardly opening upper end for receiving a refuse bag to be filled while supported on said bottom platform, a hopper supportable by said upright support structure, said hopper having an upper funnel portion supportable on said upright support structure with a lower chute portion extending into the downwardly opening upper end of said support structure and into a refuse bag supported by said platform for directing refuse introduced into said hopper upper funnel portion into a refuse bag supported by said platform, said support structure being collapsible in a vertical plane into a substantially flattened condition for storage, and said upper funnel portion and lower chute portion being collapsible in a vertical plane to a substantially flattened condition for storage.

2. The apparatus of claim 1 in which said bottom bag supporting platform is supported for pivotal movement between a substantially horizontal bag supporting position and an upwardly pivoted upward position upon collapse of said upright structure to said substantially flat condition.

3. The apparatus of claim 1 in which said upper funnel portion defines a rectangular opening complementary to the upper open end of a bag to be filled.

4. The apparatus of claim 3 including a mechanical actuator for pivoting one end of the bottom frame upwardly a predetermined amount sufficient to enable pivotal movement of said upright support structure to said substantially flat condition.

5. The apparatus of claim 4 in which said mechanical actuator includes an actuator handle pivotably mounted on said upright support structure, and a cable connecting between said actuating handle and said bottom frame for pivoting said bottom frame upwardly a predetermined distance as an incident to actuation of said bracket.

6. The apparatus of claim 4 in which said mechanical actuator is a foot operated lever on said support structure which can be selectively pivoted upwardly for pivoting the bottom frame upwardly a predetermined distance.

7. The apparatus of claim 1 in which said upper funnel portion is formed by a plurality of trapezoidal configured panels having peripheral side edges connected together by hinged joints.

8. The apparatus of claim 7 in which said lower chute portion is defined by a plurality of trapezoidal configured panels having adjacent peripheral side edges connected together by hinged joints.

9. The apparatus of claim 1 in which said upright support structure has a pair of lower support wheels adjacent one side thereof and a handle adjacent a common side of said support structure as said support wheels for permitting tipping and rolling movement of said support structure and a filled refuse bag supported thereon.

10. The apparatus of claim 1 in which said bottom bag supporting platform includes a plurality of refuse bags supporting rollers which permit rolling movement of a filled refuse bag during removal from the support structure.

11. The apparatus of claim 1 in which said upright support structure comprises an X-frame formed with a pair of rectangular frame units each having upper and lower horizontal legs interconnected by upwardly extending parallel legs, and said upwardly extending legs of said frame units being connected by hinge pins intermediate their ends for pivotal movement between an outwardly pivoted open operative position and a closed substantially flat condition.

12. The apparatus of claim 11 including an upwardly opening refuse bag storage compartment mounted on said upright support structure for storing a supply of refuse bags for usage.

13. The apparatus of claim 12 in which said refuse bag storage compartment mounted on the upright legs of one of said frame units.

14. The apparatus of claim 11 in which at least one said upwardly extending legs of one of said rectangular frame units is provided with a bracket for limiting pivotal movement of the said frame units relative to each other to a predetermined open operative condition.

15. The apparatus of claim 1 in which said hopper has fastening straps for releasably securing said hopper to said upright support structure.

16. An apparatus for facilitating filling of top opening refuse bags comprising:

a frame having a collapsible upright support structure and a bottom bag supporting platform, said upright support structure defining a downwardly opening upper end for receiving a refuse bag to be filled while supported on said bottom platform, a hopper supportable by said upright support structure having a funnel portion supportable on said upright support structure for directing refuse introduced into the hopper into a top opening refuse bag supported by said platform, said hopper funnel portion including opposing pairs of trapezoidal configured panels having peripheral side edges connected by hinged joints for permitting movement of said panels said funnel portion between an operative open condition and a substantially flat folded condition for storage.

17. The apparatus of claim 16 in which said opposing panels of one pair each is formed with a vertical hinge intermediate its peripheral side edges for permitting folding of said panels of said one pair about said intermediate hinges as an incident to folding of the hopper to said substantially flat condition.

18. The apparatus of claim 17 in which said intermediate vertical hinges of the opposing panels of said one pair are in transverse offset relation to each other and to the centers of the respective panels of said one pair.

19. The apparatus of claim 17 in which said intermediate vertical hinges of the opposing panels of said one pair are in centered relation to the respective panel.

20. The apparatus of claim 16 in which one of the trapezoidal panels of said funnel portion is formed with a cutout section to facilitate introduction of refuse into said hopper from a location directly over the hopper.

21. The apparatus of claim 16 in which said hopper chute portion includes opposing pairs of trapezoidal configured panels having peripheral side edges connected by hinged joints for permitting movement of the panels of said chute portion between an operative open condition and a substantially flat folded condition for storage.

22. The apparatus of claim 21 in which the opposing panels of one pair of each of said funnel and chute portions of said hopper each is formed with a vertical hinged intermediate its peripheral side edges for permitting folding of the panels of said hopper portions about said intermediate hinges as an incident to folding of the hopper to a substantially flat condition.

23. A method of filling refuse bags by use of an upright bag support structure and a separate hopper that is collapsible from an open operative condition to a substantially flat condition comprising the steps of:

placing and supporting a top opening refuse bag on said upright bag support structure, opening said hopper from its substantially flat condition to an open operative condition, positioning said hopper on said support structure in said open operative condition, introducing refuse into said hopper for direction from said hopper into the top opening of a refuse bag supported by said support structure until said refuse bag is filled, removing the filled refuse bag from said hopper, removing said hopper from said support structure, and collapsing said hopper into the substantially flat condition for storage.

24. The method of claim 23 including positioning a portion of said hopper into the top opening of a refuse bag supported on said upright support structure while said hopper is in said substantially flat condition, and opening said hopper to its operative position while partially within said refuse bag for opening the top of said refuse bag into a condition substantially complementary with a discharge end of said hopper.

25. The method of claim 23 including rolling said upright support structure with a refuse bag filled with refuse to a location for removal of the filled refuse bag from the upright support structure.

* * * * *